US009804540B2

(12) United States Patent
Lee

(10) Patent No.: US 9,804,540 B2
(45) Date of Patent: Oct. 31, 2017

(54) FUSING DEVICE AND IMAGE FORMING APPARATUS HAVING THE SAME

(71) Applicant: Samsung Electronics Co., Ltd., Suwon-si (KR)

(72) Inventor: Dong Woo Lee, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/285,923

(22) Filed: Oct. 5, 2016

(65) Prior Publication Data

US 2017/0102645 A1 Apr. 13, 2017

(30) Foreign Application Priority Data

Oct. 7, 2015 (KR) ..... 10-2015-0141200

(51) Int. Cl.
*G03G 15/20* (2006.01)

(52) U.S. Cl.
CPC ..... *G03G 15/2007* (2013.01); *G03G 15/2042* (2013.01)

(58) Field of Classification Search
CPC ..... G03G 15/2007; G03G 15/2042; G03G 15/2053
USPC ..... 399/330, 333, 336
See application file for complete search history.

(56) References Cited

U.S. PATENT DOCUMENTS

2004/0256372 A1* 12/2004 Yoshioka ..... H05B 3/0095 219/216
2013/0209120 A1* 8/2013 Namekata ..... G03G 15/2042 399/67
2013/0209124 A1* 8/2013 Saito ..... G03G 15/2042 399/69
2014/0270872 A1* 9/2014 Tamaki ..... G03G 15/2017 399/329
2014/0356037 A1 12/2014 Shimokawa et al.

FOREIGN PATENT DOCUMENTS

EP 1621940 2/2006
JP 2014-178370 9/2014

OTHER PUBLICATIONS

European Search Report issued in copending European Patent Application No. 16192468.3-1568 dated Apr. 20, 2017.

* cited by examiner

*Primary Examiner* — Sandra Brase
(74) *Attorney, Agent, or Firm* — Staas & Halsey LLP

(57) ABSTRACT

Disclosed herein is a fusing device. The fusing device includes a first heating source including a first heater and a first conductor connected to the first heater, a second heating source including a second heater and a second conductor connected to the second heater, a fusing member heated by at least one of the first heating source and the second heating source. The fusing device includes a pressing member disposed to face the fusing member to press a printing medium toward the fusing member, where the first heating source includes a first non-heater portion in which the first heater or the first conductor is sealed so that a part of the first heating source does not generate heat.

20 Claims, 15 Drawing Sheets

FIG.8

| PRINTING MEDIUM | MEASURE | CONVENTIONAL MODEL | MODEL ACCORDING TO ONE EMBODIMENT OF THE PRESENT DISCLOSURE |
|---|---|---|---|
| A5 PAPER (60PPM) (1050sec/ 1000 PAGES) | PRINTING TIME | 1340sec | 1062sec |
| | FUSING EFFICIENCY | 78% | 99% |
| | REMARK | INCREASED INTERVAL BETWEEN PRINTING PAPER FROM 54TH PAGE PERFORM IDLING AT 705TH, 810TH, 918TH PAGES | INTERVAL BETWEEN PRINTING PAPER DID NOT INCREASE IDLING DID NOT OCCUR |
| A4 PAPER (44PPM) (1383sec/ 1000 PAGES) | PRINTING TIME | 1640sec | 1487sec |
| | FUSING EFFICIENCY | 84% | 93% |
| | REMARK | INCREASED INTERVAL BETWEEN PRINTING PAPER FROM 83RD PAGE IDLING DID NOT OCCUR | INTERVAL BETWEEN PRINTING PAPER DID NOT INCREASE IDLING DID NOT OCCUR |
| A6 PAPER (40PPM) (1550sec/ 1000 PAGES) | PRINTING TIME | 1980sec | 1565sec |
| | FUSING EFFICIENCY | 78% | 99% |
| | REMARK | INCREASED INTERVAL BETWEEN PRINTING PAPER FROM 116TH PAGE IDLING DID NOT OCCUR | INTERVAL BETWEEN PRINTING PAPER DID NOT INCREASE IDLING DID NOT OCCUR |
| ½ A4 PAPER (32PPM) (1875sec/ 1000 PAGES) | PRINTING TIME | 2132sec | 1857sec |
| | FUSING EFFICIENCY | 88% | 100% |
| | REMARK | INCREASED INTERVAL BETWEEN PRINTING PAPER FROM 83RD PAGE PERFORM IDLING AT 392ND, 477TH, 546TH, 602ND, 653RD, 768TH, 822ND, 872ND PAGES | INTERVAL BETWEEN PRINTING PAPER INCREASED FROM 700TH PAGE (HOWEVER, MAINTAIN 32 PPM) IDLING DID NOT OCCUR |
| Legal PAPER (35PPM) (1764sec/ 1000 PAGES) | PRINTING TIME | 1882sec | 1782sec |
| | FUSING EFFICIENCY | 95% | 99% |
| | REMARK | INCREASED INTERVAL BETWEEN PRINTING PAPER FROM 8TH PAGE IDLING DID NOT OCCUR | INTERVAL BETWEEN PRINTING PAPER DID NOT INCREASE IDLING DID NOT OCCUR |

3100

FUSING DEVICE AND IMAGE FORMING APPARATUS HAVING THE SAME

CROSS-REFERENCE TO RELATED APPLICATIONS

This application claims the benefit of Korean Patent Application No. 10-2015-0141200, filed on Oct. 7, 2015 in the Korean Intellectual Property Office, the disclosure of which is incorporated herein by reference.

BACKGROUND

1. Field

Embodiments of the present disclosure relate to an image forming apparatus, and more particularly, to an image forming apparatus in which a structure of a fusing device is improved.

2. Description of the Related Art

An image forming apparatus is a device for forming an image on a printing medium according to input signals, and examples thereof include printers, copiers, facsimiles, and all-in-one devices implemented by a combination thereof.

One type of an image forming apparatus, an electrophotographic image forming apparatus, includes a photosensitive unit having a photoreceptor therein, a charging unit which is disposed near the photosensitive unit and charges the photoreceptor to a predetermined potential level, a developing unit having a developing roller, and a light scanning unit. The light scanning unit applies light onto the photoreceptor charged to the predetermined potential level by the charging unit to form an electrostatic latent image on a surface of the photoreceptor, and the developing unit supplies developers onto the photoreceptor on which the electrostatic latent image is formed to form a visible image.

The visible image formed on the photoreceptor is directly transferred to the printing medium, or passes through an intermediate transfer material and then is transferred to the printing medium, and the visible image transferred on the printing medium is fused on the printing medium while passing through a fusing device.

Generally, a fusing device includes heating sources, fusing members formed with belts or rollers, and pressing members pressed against the fusing members and configured to form a fusing nip. When a printing medium to which a toner image is transferred is moved between the fusing members and pressing members, the toner image is fused on the printing medium by heat transmitted from the fusing members and pressure applied by the fusing nip.

Here, in the case of an image forming apparatus using a halogen lamp, a dual lamp is used to print paper sheets having various sizes. The dual lamp includes a center lamp and a side lamp which have the same size.

The center lamp and the side lamp have a difference in which densities of filaments are formed to be different in a longitudinal direction of each lamp to set different heat generation distribution for each lamp. Specifically, a central portion of the center lamp is formed to generate a large amount of heat, and both sides of the side lamp are formed to generate a large amount of heat.

In an image forming apparatus using the dual lamp including the center lamp and the side lamp, both of the center lamp and the side lamp are used when large-sized paper is printed, and only the center lamp is mainly used when relatively small-sized paper is printed.

However, since filaments are also disposed in both sides of the center lamp, even when a relatively small-sized paper is printed, both sides of the center lamp generate a small amount of heat. Accordingly, even when small-sized paper sheets are consecutively printed, fusing belts or rollers are overheated because a small amount of heat generated from both sides of the center lamp is accumulated therein, and thus a fusing device performs idling for cooling to address the accumulated heat. When the small-sized paper is printed as described above, there are problems in that overheating of both sides of the center lamp and idling of the fusing device to address the overheating degrade the performance of the image forming apparatus and decrease printing speed.

SUMMARY

Therefore, it is an aspect of the present disclosure to provide an image forming apparatus including a fusing device using heating sources of two or more lamps capable of maintaining printing performance even when small-sized paper is printed.

It is another aspect of the present disclosure to provide an image forming apparatus capable of preventing an increase in printing time due to overheating of a fusing device Additional aspects of the disclosure will be set forth in part in the description which follows and, in part, will be obvious from the description, or may be learned by practice of the disclosure.

In accordance with one aspect of the present disclosure, a fusing device includes a first heating source including a first heater and a first conductor connected to the first heater, a second heating source including a second heater and a second conductor connected to the second heater, a fusing member to be heated by one or more of the first heating source and the second heating source, and a pressing member disposed to face the fusing member to press a printing medium toward the fusing member. The first heating source includes a first non-heater portion configured to block heat generated from a part of the first heating source in which a portion of the first heater or a portion of the first conductor are sealed.

The first heating source may include a first body, in which the first heater is disposed, and may be formed to extend in a width direction of the printing medium, a first heater portion including a gas in hollow provided in a part of the first body for heating the first heater may be formed in the part of the first body, and the first non-heater portion partitioned from the first heater portion may be formed in a remaining part of the first body so that the first heater or the first conductor disposed therein is blocked from the gas.

The remaining part of the first body in which the first non-heater portion is formed may be formed to surround the first heater or the first conductor by heat seal.

A cross section of the first heater portion which is perpendicular to a width direction of the printing medium may have a size or shape which is different from a cross section of the first non-heater portion which is perpendicular to a width direction of the printing medium.

The first heating source may include two or more portions having different sizes or shapes of cross sections perpendicular to a width direction of the printing medium.

The first non-heater portion may be formed on each of both ends of the first heater portion.

When the first conductor is sealed in the first non-heater portion, the first conductor may be sealed by a first sealing member having insulation or flame retardancy.

The first sealing member may be formed of glass or ceramic.

The fusing device may further include a first connection member provided between the first heater and the first conductor and configured to electrically connect the first heater and the first conductor.

The second heater may be formed to be longer than the first heater so that a second heating section of the second heater is greater than a first heating section of the first heater and includes the first heating section.

A heat value for each section of a first portion of the second heater corresponding to the first heating section may be smaller than a heat value for each section of a second portion which is a portion excluding the first portion of the second heater.

The heat value for each section of the second heater may be uniform in a width direction of the printing medium.

The second heating source may include a second heater portion disposed corresponding to the first non-heater portion; and a second non-heater portion partitioned from the second heater portion, in which the second heater or the second conductor is sealed so that heat is not generated.

The second heating source may include a second body having the second heater disposed therein and formed to extend in a width direction of the printing medium, a second heater portion including a gas in a hollow provided in a part of the second body for heating the second heater may be formed in the part of the second body, and a second non-heater portion partitioned from the second heater portion may be formed in a remaining part of the second body so that the second heater or the second conductor disposed therein is blocked from the gas.

The part of the second body in which the second non-heater is formed may be formed to surround the second heater or the second conductor by heat seal.

When the second conductor is sealed in the second non-heater, the second conductor may be sealed by a second sealing member having insulation or flame retardancy.

The second heater portion may be formed on each of both ends of the second non-heater portion.

The fusing device may further include a second connection member provided between the second heater and the second conductor and configured to electrically connect the second heater and the second conductor.

In accordance with another aspect of the present disclosure, an image forming apparatus includes a fusing device configured to fuse a visible image, which is transferred to a printing medium, to the printing medium, wherein the fusing device includes a first heating source including a first heater, a body having the first heater disposed therein and formed to extend in a width direction of the printing medium, and a first conductor connected to the first heater; a second heating source including a second heater formed to be longer than the first heater so that a second heating section, which is greater than a first heating section of the first heater and includes the first heating section, is heated, and a second conductor connected to the second heater; a fusing member to be heated by at least one of the first heating source and the second heating source; and a pressing member disposed to face the fusing member and configured to press the printing medium toward the fusing member; wherein the body includes a hollow provided therein; a first heater portion including a gas in the hollow; and a first non-heater portion to block the first heater or the first conductor from the gas in which the first heater of the first conductor is sealed.

The part of the body in which the first non-heater portion is formed may be formed to surround the first heater or the first conductor by heat seal.

In accordance with still another aspect of the present disclosure, a fusing device, includes a fusing member configured to fuse a visible image to a printing medium; a pressing member disposed to face the fusing member and configured to press the printing medium toward the fusing member; a first halogen lamp including a halogen gas and a first heater extending in a width direction of the printing medium to heat the fusing member and provided with a first non-heater portion in which a part of the first heater is sealed for blocking the halogen gas so that heat is not generated; and a second halogen lamp provided with a second heater extending in the width direction of the printing medium to heat the fusing member.

The first halogen lamp may include a body configured to accommodate the first heater therein, and a part of the body in which the first non-heater portion is formed may be formed to surround the first heater by heat seal.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 8 is a comparison table for the printing performance of the image forming apparatus illustrated in FIG. 1 and a conventional apparatus;

DETAILED DESCRIPTION

Figure 1:
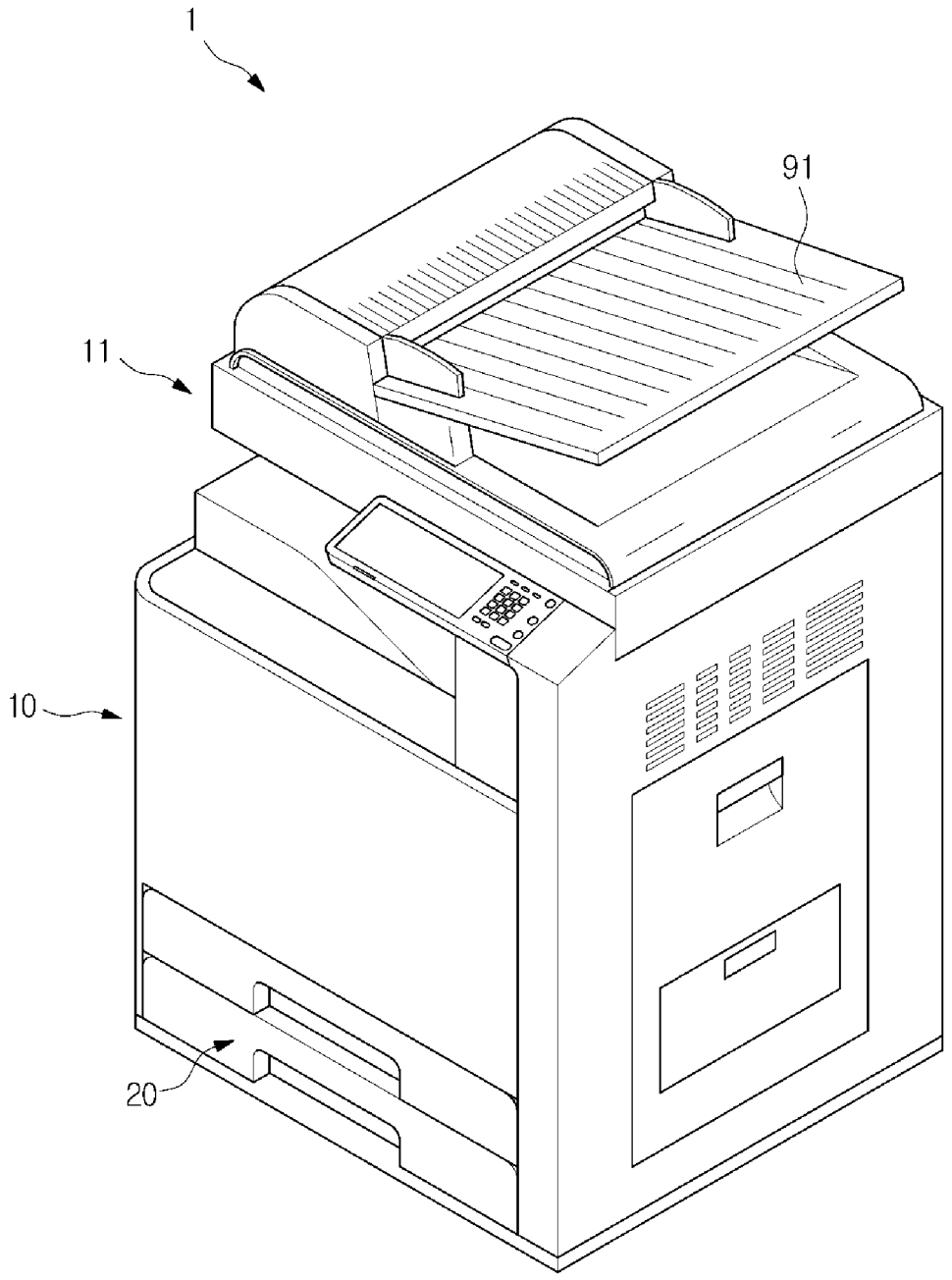
FIG. 1 is a perspective view of an image forming apparatus according to one embodiment of the present disclosure.

The descriptions proposed herein are just preferred examples for the purpose of illustration only so it should be understood that other equivalents and modifications could be made thereto without departing from the spirit and scope of the disclosure.

Also, like reference numerals or symbols provided in each of the drawings indicate components or elements performing the same functions.

Also, the terms used herein are merely to describe a specific embodiment, and do not limit the present disclosure.

Further, unless the context clearly indicates otherwise, singular expressions should be interpreted to include plural expressions. It should be understood that the terms "comprises," "comprising," "includes" or "has" are intended to indicate the presence of features, numerals, steps, operations, elements and components described in the specification or the presence of combinations of these, and do not preclude the presence of one or more other features, numerals, steps, operations, elements and components, the presence of combinations of these, or additional possibilities.

Also, the terms including ordinal numbers such as "first," "second," etc. can be used to describe various components, but the components are not limited by those terms. The terms are used merely for the purpose of distinguishing one component from another. For example, a first component may be referred to a second component, and similarly, a second component may be referred to a first component without departing from the scope of rights of the disclosure. The term "and/or" encompasses combinations of a plurality of items or any one of the plurality of items.

Hereinafter, embodiments according to the present disclosure will be described with reference to the accompanying drawings in detail.

Figure 2:
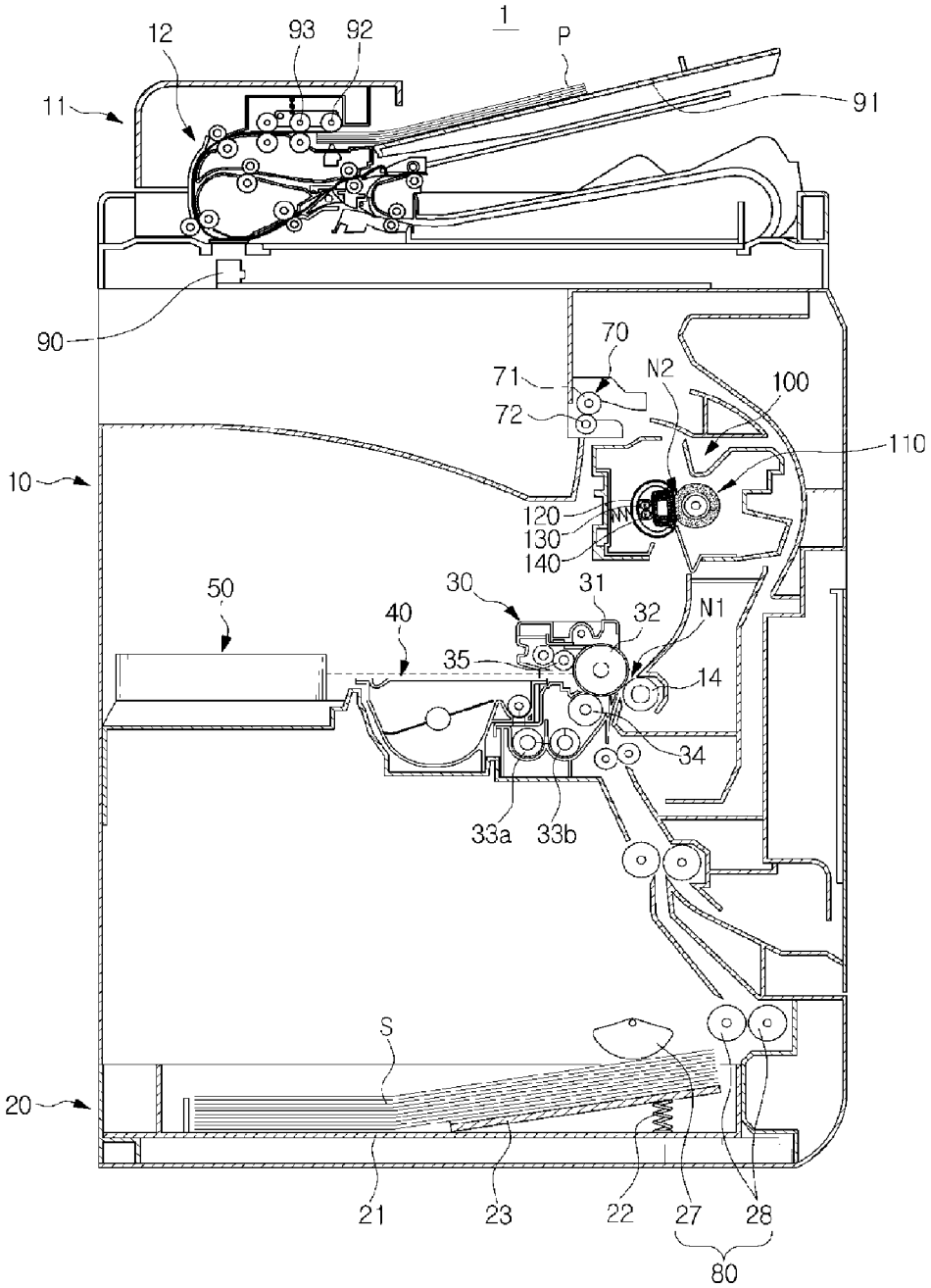
FIG. 2 is a schematic view illustrating a configuration of the image forming apparatus illustrated in FIG. 1.

FIG. 1 is a perspective view of an image forming apparatus 1 according to one embodiment of the present disclosure, and FIG. 2 is a schematic view illustrating a configuration of the image forming apparatus illustrated in FIG. 1.

As shown in FIGS. 1 and 2, the image forming apparatus 1 includes a main body 10, a paper feeding device 20 for storing and delivering a printing medium S, a developing device 30 configured to form an image on the printing medium S supplied from the paper feeding device 20, a toner device 40 configured to supply toner into the developing device 30, a light scanning device 50 configured to form an electrostatic latent image on a photoreceptor 32 of the developing device 30, a fusing device 100 configured to fuse a toner image, which is transferred to the printing medium S, to the printing medium S, and an ejecting device 70 configured to discharge the printing medium S, on which the image is completely formed, to the outside of the main body 10.

The paper feeding device 20 is for storing and delivering the printing medium S. The paper feeding device 20 is provided in a lower portion of the main body 10 and supplies the printing medium S toward the developing device 30.

The paper feeding device 20 may store the printing medium S and include a cassette 21 detachably coupled to the main body 10 and a transfer member 80 configured to pick up the printing medium S stored in the cassette 21 one sheet at a time and deliver the picked-up printing medium S to the developing device 30.

A knock-up plate 23, whose one end is rotatably coupled to the cassette 21 and the other end is supported by a press spring 22 so that stacked printing media S are guided to the transfer member 80, may be provided in the cassette 21.

The transfer member 80 may include a pick-up roller 27 configured to pick up the printing media S stacked in the knock-up plate 23 one sheet at a time and a feeding roller 28 configured to deliver the printing medium S picked-up by the pick-up roller 27 to the developing device 30.

The developing device 30 includes a housing 31 configured to form an exterior thereof, a photoreceptor 32 rotatably coupled into the housing 31 and configured to form an electrostatic latent image on a surface thereof, stir screws 33*a* and 33*b* configured to stir the toner supplied from the toner device 40, a developing roller 34 configured to supply the toner stirred by the stir screws 33*a* and 33*b* to the photoreceptor 32, and a charging member 35 configured to charge the photoreceptor 32.

The toner supplied from the toner device 40 flows into the housing 31 and is stirred by the stir screws 33*a* and 33*b* and delivered to one side of the housing 31, and the stirred and delivered toner is supplied to the photoreceptor 32 by the developing roller 34 to form a visible image.

The photoreceptor 32 comes into contact with a transfer roller 14 to form a transfer nip N1 for transferring the toner, which is supplied to the photoreceptor 32 to form the visible image, to the printing medium S. The transfer roller 14 is rotatably disposed inside the main body 10.

The toner device 40 is coupled to the developing device 30. The toner device 40 accommodates and stores toner for forming an image on a printing medium S and supplies the toner to the developing device 30 when an image forming operation is performed.

The light scanning device 50 applies light having image information to the photoreceptor 32 to form an electrostatic latent image on the photoreceptor 32.

The fusing device 100 fuses a toner image, which is transferred to the printing medium S by the photoreceptor 32 and the transfer roller 14, to the printing medium. The detailed description of the fusing device 100 will be described below.

Meanwhile, the ejecting device 70 includes a first ejecting roller 71 and a second ejecting roller 72 which are interlocked with each other and discharges the printing medium S passed through the fusing device 100 to the outside of the main body 10.

An image scanning device 11 for scanning a document P may be positioned on the main body 10. The image scanning device 11 includes a document supply tray 91 on which a document P which will be scanned is loaded, a pick-up roller 92 configured to pick up the document P loaded on the document supply tray 91 and move the document P to a transfer path 12, and a feeding roller 93 configured to deliver the picked-up document P. The document P delivered by the feeding roller 93 is scanned by a scanner module 90 and may then be guided to an outlet (not shown) positioned under the document supply tray 91.

Figure 3:
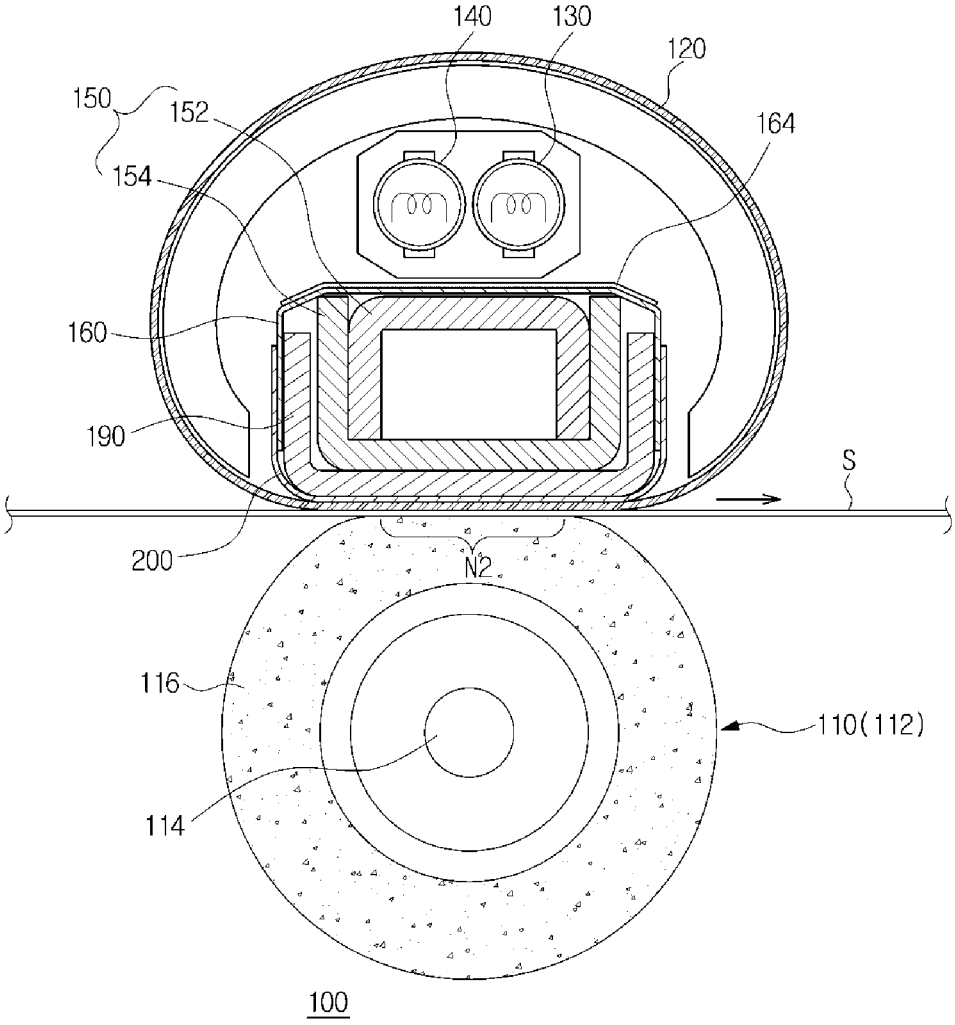
FIG. 3 is a cross-sectional view illustrating a fusing device illustrated in FIG. 2.
Figure 4:
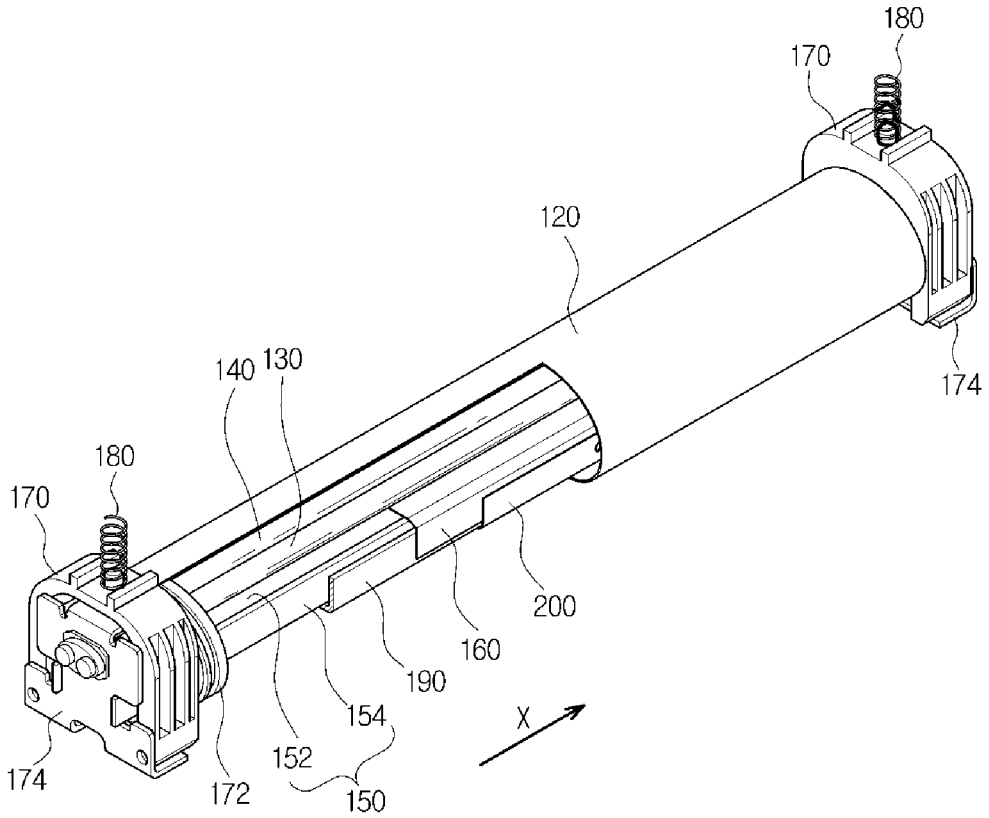
FIG. 4 is a partial cross-sectional view illustrating the fusing device illustrated in FIG. 2.

FIG. 3 is a cross-sectional view illustrating the fusing device 100 illustrated in FIG. 2, and FIG. 4 is a partial cross-sectional view illustrating the fusing device 100 illustrated in FIG. 2.

Hereinafter, a width direction of a printing medium S, a longitudinal direction of a pressing member 110, a longitudinal direction of a fusing member 120, and longitudinal directions of a first heating source 130 and a second heating source 140 are defined as the same direction X.

As shown in FIGS. 3 and 4, the fusing device 100 includes the pressing member 110, the fusing member 120, the first heating source 130, and the second heating source 140.

A printing medium S, on which a toner image is transferred, passes between the pressing member 110 and the fusing member 120, and at this point, the toner image is fused on the printing medium by heat and pressure.

The pressing member 110 is disposed to be in contact with an outer circumferential surface of the fusing member 120 to form a fusing nip N2 between the pressing member 110 and the fusing member 120. The pressing member 110 may be configured with a pressing roller 112 configured to rotate using power received from a driving source.

The pressing roller 112 includes a shaft 114 formed of a metallic material, such as aluminum or steel, and an elastic layer 116 elastically modified to form the fusing nip N2 between the pressing roller 112 and the fusing member 120. The elastic layer 116 is generally formed of silicone rubber. As a high fusing pressure is applied from the fusing nip N2 to the printing medium S, it is preferable that hardness of the elastic layer 116 be in a range of 50 to 80 based on a hardness reference of ASKER-C and a thickness of the elastic layer 116 be in a range of 3 mm to 6 mm. A hetero-layer (not shown) configured to prevent the printing medium S from attaching onto the pressing roller 112 may be provided on a surface of the elastic layer 116.

The fusing member 120 is interconnected and rotated with the pressing roller 112, forms the fusing nip N2 with the pressing roller 112, and is heated by at least one of the first heating source 130 and the second heating source 140 to transmit heat to the printing medium S passing through the fusing nip N2. The fusing member 120 may be configured with a single layer containing a metal, a heat resistance polymer, or the like, or may be configured by adding elastic and protection layers on a base layer formed of a metal or heat resistance polymer. An inner surface of the fusing member 120 may be painted black or treated with a black coating for expediting heat absorption.

Figure 5:
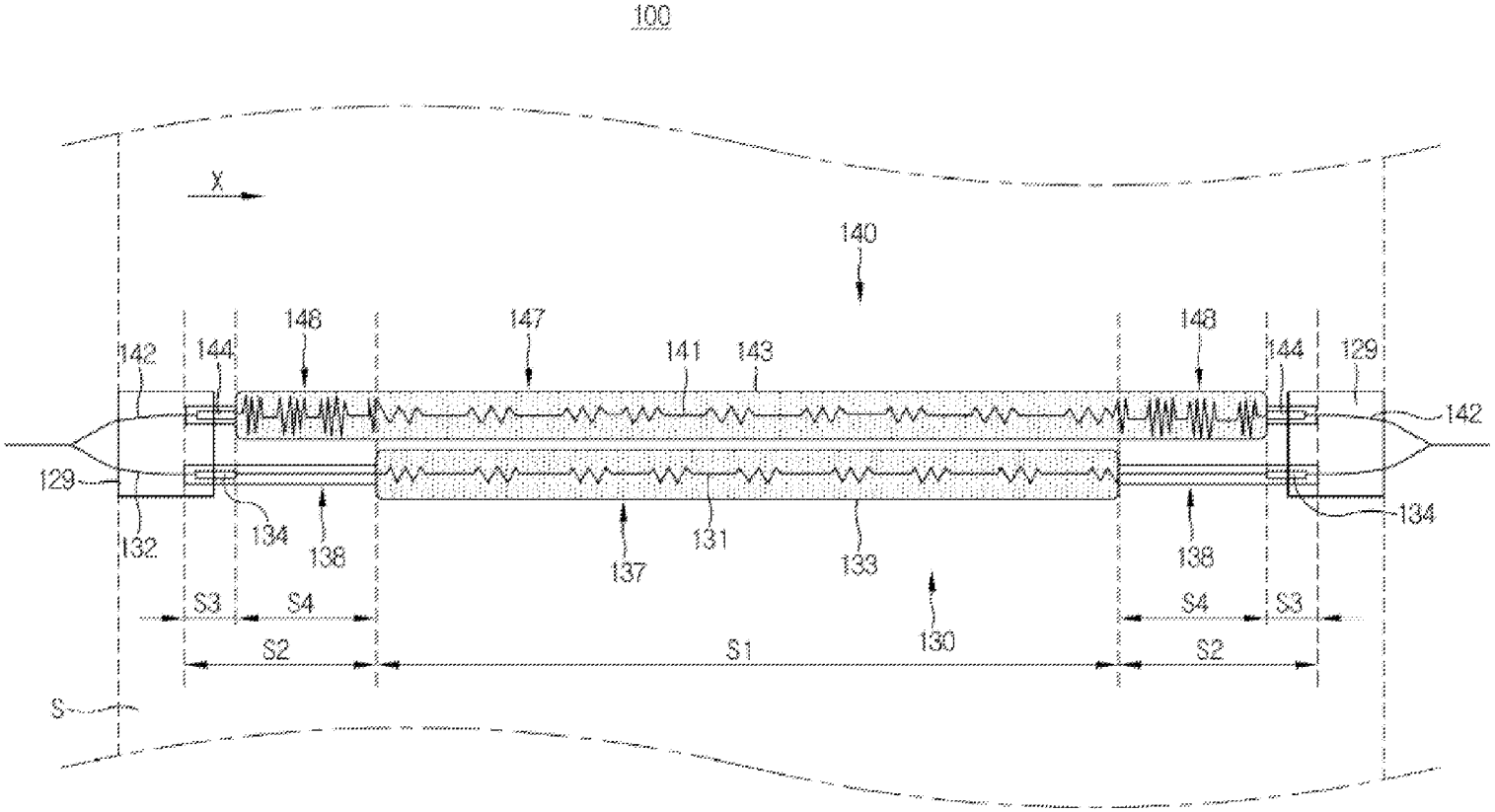
FIG. 5 is a schematic view illustrating first and second heating sources of the fusing device illustrated in FIG. 2.

Referring to FIG. 5, the first heating source 130 and the second heating source 140 are disposed to directly radiate heat onto at least a part of an inner circumferential surface of the fusing member 120, and are provided to have a length corresponding to the sum of lengths of a first section S1 and a second section S2 which are necessary for heating the printing medium S. Here, the first section S1 is a section in which heating is necessary when a printing medium S having a relatively small width is printed, and the second section S2 is a section in which heating is necessary when a printing medium S having a relatively large width is printed. The second section S2 is disposed on each of both ends of the first section S1.

The first heating source 130 includes a first heater 131 configured to heat the first section S1 of the printing medium for heating the printing medium S having a relatively small width, a first conductor 132 electrically connected to the first heater 131 so that the first heater 131 generates heat, a first body 133 configured to accommodate a part of the first heater 131 and the first conductor 132, and a first connection member 134 configured to electrically connect the first heater 131 and first conductor 132.

The first heater 131 is disposed inside the first body 133 and generates heat when electricity flows in the first heater 131 by the first conductor 132 electrically connected to each of both ends thereof. The first heater 131 may be a tungsten filament configured to generate heat when a current is supplied. The first heater 131 extends in a width direction of the printing medium S by a preset length.

The part of the first heater 131 corresponding to the first section S1 may form a first heater portion 137 and may be disposed to have relatively high density. Specifically, the first heater 131 may be disposed in a zigzag or spring shape within a section corresponding to the first section S1. Accordingly, the first heater portion 137 corresponding to the first section S1 may sufficiently heat the fusing member 120 through the first heater 131.

Otherwise, referring to FIGS. 5 and 6, when the printing medium S having a relatively small width is printed, a remaining part of the first heater 131 included in a fourth section S4 of the second section S2 of the printing medium except a third section S3, in which the first heater 131 is connected to the first conductor 132 by the first connection member 134 which will described below, is provided to have relatively low density. Specifically, in a first non-heater portion 138 which is a portion included in the fourth section S4, the first heater 131 may be disposed in a linear shape rather than in a zigzag shape. In addition to the above arrangement, the remaining part of the first heater 131 included in the first non-heater portion 138 is disposed so that halogen gas is blocked by a part of the first body 133 which will be described below, and thus, when the printing medium S having a small width is printed, heat may be hardly generated. Accordingly, the present disclosure can prevent a decrease in printing performance generated when the printing medium having a relatively small width is printed and can prevent a decrease in printing speed due to overheating.

The first conductor 132 is electrically connected to each of both ends of the first heater 131 in the third section S3 and supplies a current into the first heater 131 so that the first heater 131 generates heat. The first conductor 132 may use an I-pin formed of a metallic material such as stainless.

Specifically, the first conductor 132 is electrically connected to the first heater 131 in the third section S3 which is a part of a section in a fixing portion 129 of the second section S2. The third section S3 is included in the second section S2. In the third section S3, the first heater 131 and the first conductor 132 may be directly connected to each other by welding and may be connected through the first connection member 134. Here, a foil formed of molybdenum material (Mo-foil) may be used as the first connection member 134, but the present disclosure is not limited thereto.

The first conductor 132 and a second conductor 142 of the second heating source 140, which will be described below, receive power from the outside.

The first body 133 has a tube shape extending in the width direction of the printing medium S and accommodates the first heater 131 therein. The first body 133 may be a glass tube.

Specifically, a preset-sized hollow is formed inside a portion corresponding to the first section S1 of the first body 133, and the first heater 131 may be accommodated inside the hollow. Accordingly, a part of the first body 133 corresponding to the first section S1 generates heat because a current flows in the first heater 131. That is, a part of the first heating source 130 corresponding to the first section S1 forms a first heater portion.

Here, the first body 133 may include a halogen gas therein, which extends the lifetime of the first heater 131 and the first heater 131.

Figure 6:
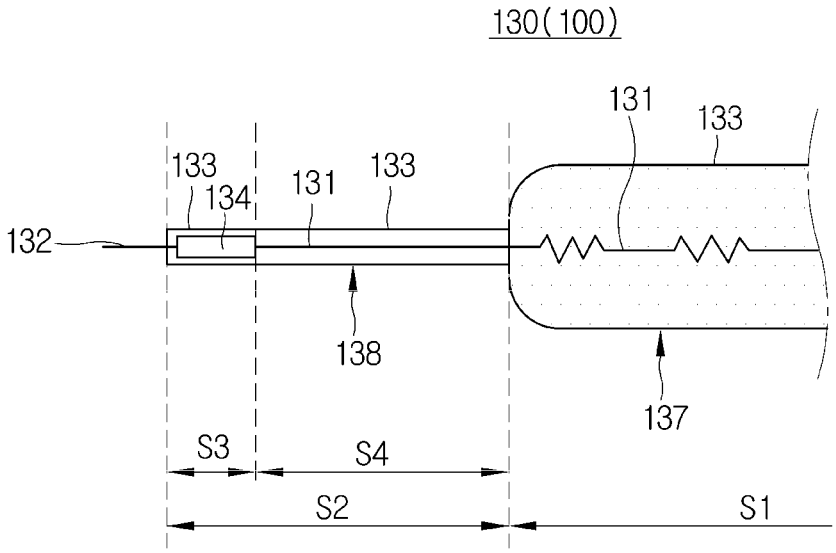
FIG. 6 is an enlarged view of a first non-heater portion of the first heating source illustrated in FIG. 5.

Otherwise, referring to FIG. 6, a portion corresponding to the fourth section S4 of the first body 133 is formed to include only the first heater 131 without a halogen gas therein by heat seal. That is, a part of the first body 133 corresponding to the fourth section S4 surrounds the first heater 131 and seals the first heater 131 to form the first non-heater portion 138. Accordingly, the first heater 131 disposed in the first non-heater portion 138 is blocked from the halogen gas and heat is hardly generated. That is, a remaining part of the first heating source 130 corresponding to the fourth section S4 becomes the first non-heater portion 138.

Since the first body 133 included in the first non-heater portion 138 surrounds and seals the first heater 131, the first non-heater portion 138 may have a smaller diameter than the first heater portion 137. Specifically, the first body 133 included in the first non-heater portion 138 may be heated to be in a state in which a shape thereof is changeable and then formed by pressing the first body 133 from all directions of the circumference thereof toward the center of a tube or formed by pressing the first body 133 from one side facing the first body 133. Accordingly, a cross section of the first non-heater portion 138 of the first heating source 130 may be a circular shape or elliptical shape. Further, a diameter of the cross section of the first non-heater portion 138 of the first heating source 130 may be smaller than that of a cross section of the first heater portion 137. Furthermore, the cross section of the first non-heater portion 138 of the first heating source 130 may have a smaller area than the cross section of the first heater portion 137. As described above, the first heating source 130 may include the first heater portion 137 and the first non-heater portion 138 which have different shapes and/or sizes.

The second heating source 140 includes a second heater 141 configured to heat the first section S1 and the fourth section S4 for heating a printing medium S having a relatively large width, a second conductor 142 electrically connected to the second heater 141 so that the second heater 141 generates heat, a second body 143 configured to accommodate a part of the second heater 141 and the second conductor 142, and a second connection member 144 configured to electrically connect the second heater 141 and the second conductor 142.

The second heater 141 is disposed inside the second body 143 and generates heat when a current is supplied by the second conductor 142 electrically connected to each of both ends thereof. The second heater 141 may be a tungsten filament configured to generate heat when a current is supplied, similar to the above-described first heater 131. The second heater 141 extends in the width direction of the printing medium S by a preset length.

Specifically, the part of the second heater 141 included in a first portion 147 of the second heating source 140 corresponding to the first section S1 may be provided to have lower density than a remaining part of the second heater 141 included in a second portion 148 of the second heating source 140 corresponding to the fourth section S4. Here, the second heater 141 may be disposed so that the sum of a heat value for each section of the first heater 131 included in the first heater portion 137 and a heat value for each section of the second heater 141 included in the first portion 147 of the second heating source 140 becomes roughly the same as a heat value for each section of the second heater 141 included in the second portion 148 of the second heating source 140. Accordingly, the first heating source 130 and the second heating source 140 may uniformly heat the entire fusing member 120. As described above, all portions, in which the second heater 141 is disposed, of the second heating source 140 heat the printing medium S unlike the first heating source 130.

The second conductor 142 is electrically connected to each of both ends of the second heater 141 and supplies a current into the second heater 141 so that the second heater 141 may generate heat. Specifically, the second conductor 142 is electrically connected to the second heater 141 in the third section S3. Here, the second heater 141 and the second conductor 142 may be directly connected to each other by welding or be connected through the second connection member 144, similar to the first heater 131 and the first conductor 132. Here, the second connection member 144 may be a Mo-foil like the above-described first connection member 134.

The second conductor 142 and the first conductor 132 of the first heating source 130 receive power from the outside.

The second body 143 may extend in the width direction of the printing medium S and accommodate the second heater 141 therein. The second body 143 may be a glass tube similar to the first body 133. Further, the second body 143 may include a halogen gas to extend the lifetime of the second heater 141. Accordingly, the portion corresponding to the first section S1 and the fourth section S4 of the second heating source 140 generates heat by the second heater 141. That is, the second heating source 140 may have roughly the same shape and size of cross sections in a longitudinal direction, unlike the first heating source 130.

Both ends of each of the above-described first heating source 130 and second heating source 140 are primarily fixed by the fixing portion 129 in the third sections S3.

As described above, to describe one embodiment of the present disclosure, only the first and second heating sources 130 and 140 are described for convenience of descriptions, but additional heating sources may be provided to print paper sheets having various widths.

Referring to FIG. 4, side frames 170 may further be disposed on both sides of the fusing member 120. The side frames 170 support components forming the fusing device 100. The fusing member 120 may be rotatably supported by the side frames 170. Each of the side frames 170 protrudes toward the fusing member 120 and has a fusing member supporter 172 configured to support an end portion of the fusing member 120.

The side frame 170 is pressurized toward the pressing member 110 by an elastic member 180. One end of the elastic member 180 is supported by an upper portion of the side frame 170, and the other end is supported by a separate frame.

A holder 174 is coupled to each side frame 170. The holder 174 is disposed on an outer surface of the side frame 170 and supports end portions of the first heating source 130 and the second heating source 140 and an end portion of a support member 150. Pressure applied to the side frame 170 is transmitted to the support member 150 through the holder 174, and accordingly, the support member 150 is pressurized toward the pressing member 110.

Further, the fusing device 100 may further include the support member 150.

The support member 150 presses an inner circumferential surface of the fusing member 120 to form the fusing nip N2 between the fusing member 120 and the pressing member 110. The support member 150 may be formed of a material having excellent solidity such as stainless, carbon steel, etc.

When solidity of the support member 150 is low, the fusing nip N2 may not be uniformly pressurized because large bending deformation occurs. Accordingly, the support member 150 includes a first support member 152 having a cross section in an arcuate shape and a second support member 154 having a cross section in a reversed-arcuate shape to reduce the bending deformation, and the first support member 152 is coupled to the second support member 154 so that at least a part of the first support member 152 is included in the inside of the second support member 154. The support member 150 may be formed to have a structure having a large cross sectional moment of inertia such as I-beam type, H-beam type, or the like in addition to the arcuate shape or reversed-arcuate shape.

When heat generated from the first and/or second heating sources 130 and/or 140 directly heats the support member 150, the support member 150 is thermally deformed because a temperature thereof becomes high, and thus the fusing nip N2 may not be uniformly pressurized. Further, a large amount of heat radiated from the first and/or second heating sources 130 and/or 140 is consumed for heating the support member 150, and thus the performance of increasing a temperature of the fusing device 100 is decreased.

Thus, the fusing device 100 may further include a heat blocking member 160 disposed between the first and second heating sources 130 and 140 and the support member 150. The heat blocking member 160 is disposed to surround at least a part of the support member 150, particularly, an upper portion of the support member 150 facing the first and second heating sources 130 and 140, to block heat from directly radiating to the support member 150, and thus thermal deformation of the support member 150 is prevented.

The heat blocking member 160 may include a reflection layer 164 configured to reflect heat of the first and second heating sources 130 and 140. The reflection layer 164 may be provided on a surface of the heat blocking member 160 facing the first and second heating sources 130 and 140. The reflection layer 164 may be formed by coating a reflective material, such as silver, on the heat blocking member 160. As described above, when the reflection layer 164 is formed on the heat blocking member 160, heat radiated to the heat blocking member 160 is reflected toward the fusing member 120, and thus heating of the fusing member 120 may be expedited.

The heat blocking member 160 is formed of a material having excellent thermal conductivity. The heat blocking member 160 may be formed of a material having higher thermal conductivity than the support member 150. For example, the heat blocking member 160 may be formed of aluminum, copper, or an alloy of metals.

Further, the fusing device 100 may further include a nip forming unit 190. The nip forming unit 190 has a cross section in a reversed-arcuate shape and separates the fusing member 120 from the support member 150 so that heat of the fusing member 120 is not transmitted to the support member 150. The nip forming unit 190 is formed of a material having low thermal conductivity and heat resistance. The nip forming unit 190 may be formed of a material having lower thermal conductivity than an auxiliary support member 200. For example, the nip forming unit 190 is formed of a polymeric compound, a heat resistance resin, such as a polyether ether ketone (PEEK), a liquid crystal polymer (LCP), or the like, ceramic, etc.

Furthermore, the fusing device 100 may further include the auxiliary support member 200. The auxiliary support member 200 is provided between the nip forming unit 190 and the fusing member 120, and thus an insulating effect of the nip forming unit 190 is improved and friction is decreased.

The auxiliary support member 200 may be configured in a reversed-arcuate shape to surround a lower portion of the nip forming unit 190 or formed in the same shape as the nip forming unit 190 configured to support an inner surface of the fusing member 120 to cover only a lower surface of the nip forming unit 190.

Hereinafter, an operation of the image forming apparatus 1 according to one embodiment of the present disclosure, which is formed to have the above configuration, will be described.

Referring to FIG. 2, when a printing medium S having a relatively large width is printed by the image forming apparatus 1, the printing medium S passes through the paper feeding device 20 and the developing device 30 and is delivered to the fusing device 100 with a visible image transferred.

Referring to FIG. 5, the fusing device 100 supplies power to the first and second heating sources 130 and 140 for fusing the transferred visible image on the printing medium S in pressing and heating processes. Specifically, a portion included in the first heater portion 137 of the first heater 131 receives power through the first conductor 132 and generates heat, and a portion included in the first portion 147 and the second portion 148 of the second heater 141 receives power through the second conductor 142 and generates heat. At this point, a portion included in the first non-heater portion 138 of the first heater 131 is sealed to be blocked from the halogen gas, and thus heat is hardly generated even when the power is received.

Further, since the sum of a heat value for each section of the first heater 131 included in the first heater portion 137 and a heat value for each section of the second heater 141 included in the first portion 147 of the second heating source 140 is roughly the same as a heat value for each section of the second heater 141 included in the second portion 148 of the second heating source 140, the first and second heating sources 130 and 140 uniformly heat the fusing member 120 in the width direction of the printing medium S.

Otherwise, when a printing medium S having a relatively small width is printed by the image forming apparatus 1, the fusing device 100 supplies power to only the first heating source 130. Accordingly, a portion included in the first heater portion 137 of the first heater 131 receives a current and generates heat and, since a portion included in the first non-heater portion 138 of the first heater 131 is sealed to be blocked from the halogen gas and disposed to have relatively low density, heat is hardly generated even when power is received.

Figure 7:
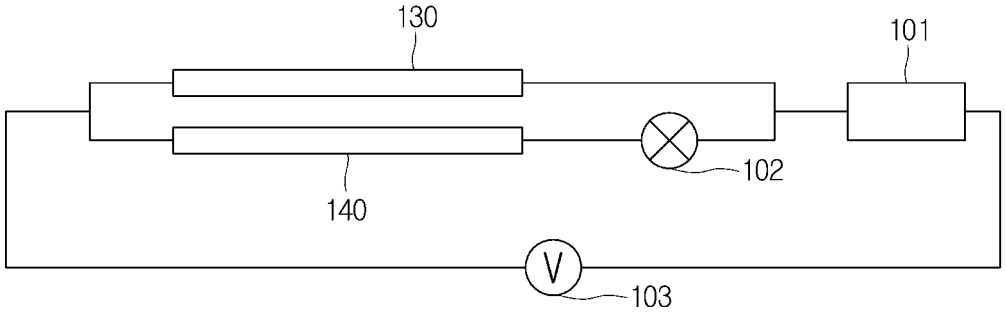
FIG. 7 is a schematic view illustrating a configuration for controlling the first heating source and the second heating source of the fusing device illustrated in FIG. 5.

Specifically, referring to FIG. 7, the first heating source 130 and the second heating source 140 are connected in parallel, and a switching element 102 is disposed at the second heating source 140. When a printing medium S having a relatively large width is printed, the switching element 102 is turned on to supply a current to the second heating source 140 and, when a printing medium S having a relatively small width is printed, the switching element 102 is turned off to block a current from being supplied to the second heating source 140. Accordingly, even when the fusing device controller 101 receives power from a voltage generator 103 and electricity flows in the fusing device 100, a current may be selectively supplied to the second heating source 140.

Accordingly, when the printing medium S having a relatively small width is printed, the first heating source 130 does not heat a section (the second section S2 of the present embodiment) excluding a section which needs to be heated (the first section S1 of the present embodiment), and thus a decrease in printing performance and a decrease in printing speed due to overheating can be prevented.

Referring to a table in FIG. 8, effects of a case in which the fusing device according to one embodiment of the present disclosure is used will be described.

When an A5-sized printing medium S was printed in a longitudinal direction (i.e., printed in a vertical direction), the general printing speed was 60 pages per minute (PPM), and the reference time was 1050 seconds for printing 1000 pages. When printing was performed using the fusing device of a conventional apparatus, the printing time was 1340 seconds, and the fusing efficiency (reference printing time/actual printing time) was about 78%. However, when printing was performed using the fusing device 100 according to one embodiment of the present disclosure, the printing time was 1062 seconds, and the fusing efficiency was about 99%. Further, when printing was performed using the fusing device of the conventional apparatus, due to overheating, an interval between the printing media S being passed through the fusing device began to increase from the $54^{th}$ page, and idling for cooling was performed at time points of printing the 705$^{th}$, 810$^{th}$, and 918$^{th}$ pages. However, when printing was performed using the fusing device 100 according to one embodiment of the present disclosure, an increase in the interval between printing media S due to overheating did not occur, and idling for cooling also did not occur.

When an A4-sized printing medium S was printed in a longitudinal direction, the general printing speed was 44 PPM, and the reference time was 1383 seconds for printing 1000 pages. When printing was performed using the fusing device of the conventional apparatus, the printing time was 1640 seconds, and the fusing efficiency was about 84%. However, when printing is performed using the fusing device 100 according to one embodiment of the present disclosure, the printing time was 1487 seconds, and the fusing efficiency was about 93%. Further, when printing was performed using the fusing device of the conventional apparatus, due to overheating, an interval between printing media S being passed through the fusing device began to increase from the 83$^{rd}$ page. However, when printing was performed using the fusing device 100 according to one embodiment of the present disclosure, an increase in the interval between printing media S due to overheating did not occur.

When an A6-sized printing medium S was printed in a longitudinal direction, the general printing speed was 40 PPM, and the reference time was 1550 seconds for printing 1000 pages. When printing was performed using the fusing device of the conventional apparatus, the printing time was 1980 seconds, and the fusing efficiency was about 78%. However, when printing was performed using the fusing device 100 according to one embodiment of the present disclosure, the printing time was 1565 seconds, and the fusing efficiency was about 99%. Further, when printing was performed using the fusing device of the conventional apparatus, due to overheating, an interval between printing media S being passed through the fusing device began to increase from the 116$^{th}$ page. However, when printing was performed using the fusing device 100 according to one embodiment of the present disclosure, an increase in the interval between printing media S due to overheating did not occur.

When a printing medium S having a size, which was made when the half of an A4-sized printing medium S is cut in a longitudinal direction, was printed in a longitudinal direction, the general printing speed was 32 PPM, and the reference time was 1875 seconds for printing 1000 pages. When printing was performed using the fusing device of the conventional apparatus, the printing time was 2132 seconds, and the fusing efficiency was about 88%. However, when printing was performed using the fusing device 100 according to one embodiment of the present disclosure, the printing time was 1857 seconds, and the fusing efficiency was about 100%. Further, when printing was performed using the fusing device of the conventional apparatus, due to overheating, an interval between printing media S being passed through the fusing device began to increase from the 83$^{rd}$ page, and idling for cooling was performed at time points of printing the 392$^{nd}$, 477$^{th}$, 546$^{th}$, 602$^{nd}$, 653$^{rd}$, 768$^{th}$, 822$^{nd}$, and 872$^{nd}$ pages. However, when printing was performed using the fusing device 100 according to one embodiment of the present disclosure, an interval between printing media S being passed through the fusing device 100 began to increase from the 700$^{th}$ page, and the interval between printing media S is slightly increased, but the printing speed was maintained as 32 PPM. Further, idling for cooling also did not occur.

When a legal paper was printed, the general printing speed was 35 PPM, and the reference time was 1764 seconds for printing 1000 pages. When printing was performed using the fusing device of the conventional apparatus, the printing time was 1862 seconds, and the fusing efficiency was about 95%. However, when printing was performed using the fusing device 100 according to one embodiment of the present disclosure, the printing time was 1782 seconds, and the fusing efficiency was about 99%. Further, when printing was performed using the fusing device of the conventional apparatus, due to overheating, an interval between printing media S being passed through the fusing device began to increase from the 8$^{th}$ page. However, when printing was performed using the fusing device 100 according to one embodiment of the present disclosure, an increase in the interval between printing media S due to overheating did not occur.

As described above, when printing media S having various sizes were printed using the fusing device 100 of the present disclosure, the interval between printing media S being passed through the fusing device did not increase, idling for overheating was not performed, and thus the printing time was decreased and the fusing efficiency was increased. Particularly, when the printing medium S having a relatively small size was printed, the fusing efficiency shows a bigger difference. That is, when the fusing device 100 of the present disclosure was used, a temperature of the first non-heater portion 138 of the first heating source 130 was lowered from about 220° C. to about 170° C., and thus a decrease in printing performance due to overheating can be prevented.

A fusing device 1100 according to another embodiment of the present disclosure will be described with reference to FIG. 9. However, to describe the fusing device 1100 according to the embodiment illustrated in FIG. 9, since the second heating source 140 is the same as that in the embodiment illustrated in FIG. 5, a description thereof will be omitted, and a first heating source 1130 which is different from that in the embodiment illustrated in FIG. 5 will be described in detail.

Figure 9:
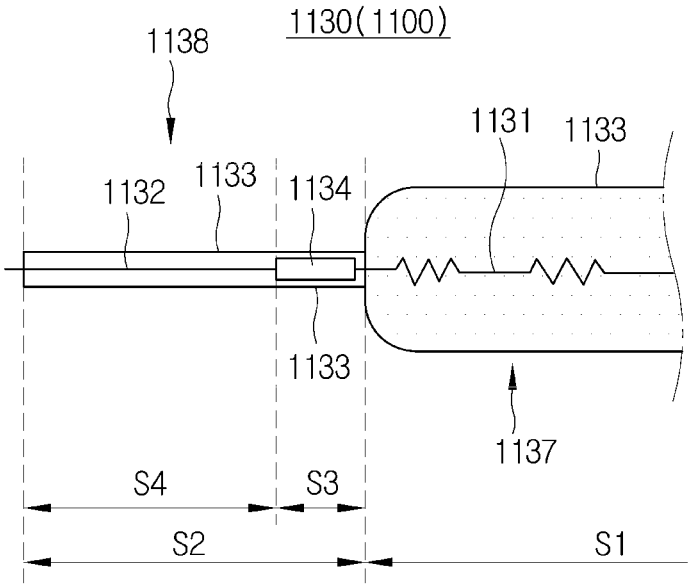
FIGS. 9 and 10 are views illustrating various modified embodiments of the first non-heater portion illustrated in FIG. 6.

Referring to FIG. 9, the first heating source 1130 includes a first heater 1131 configured to heat a first section S1 for heating a printing medium S having a relatively small width, a first conductor 1132 electrically connected to the first heater 1131 so that the first heater 1131 generates heat, a first body 1133 configured to accommodate a part of the first heater 1131 and the first conductor 1132, and a first connection member 1134 configured to electrically connect the first heater 1131 and the first conductor 1132.

The first heater 1131 is disposed inside the first body 1133 and generates heat when a current is supplied by the first conductor 1132 electrically connected to each of both ends thereof. The first heater 1131 may be a tungsten filament configured to generate heat when a current is supplied and may extend in the width direction of the printing medium S by a preset length.

The first heater 1131 is provided in only a first heater portion 1137 corresponding to the first section S1, which is unlike the above embodiment, and the first conductor 1132 is electrically connected to each of both ends of the first heater 1131. Here, the first heater 1131 and the first conductor 1132 may be connected to each other by welding similar to that in the embodiment illustrated in FIG. 5, or may be connected through the first connection member 1134.

Specifically, unlike the embodiment illustrated in FIG. 5, the third section S3 configured to electrically connect the first heater 1131 and the first conductor 1132 is disposed at each of both ends of the first section S1. That is, in the case of the embodiment illustrated in FIG. 9, the first section S1, the third section S3, and the fourth section S4 are sequentially disposed from the center to each of both ends of the first heating source 1130 in a longitudinal direction of the first heating source 1130.

In the fourth section S4, the first conductor 1132 is sealed by the first body 1133 to form a first non-heater portion 1138. Specifically, a portion corresponding to the fourth section S4 of the first body 1133 may include the first conductor 1132 therein and is formed without a hollow therein by heat seal.

The first heating source 1130 according to the embodiment illustrated in FIG. 9 is formed with a first heater portion 1137, in which the first heater 1131 generates heat in a portion corresponding to the first section S1, and a first non-heater portion 1138, in which heat is hardly generated in a portion corresponding to the second section S2 including the third section S3 and the fourth section S4, even when power is supplied through the first conductor 1132 similar to the embodiment illustrated in FIG. 5.

Accordingly, the first heating source 1130 according to the embodiment illustrated in FIG. 9 may prevent a decrease in printing performance and a decrease in printing speed due to overheating in an unnecessary portion even when the printing medium S having a relatively small width is printed similar to the embodiment illustrated in FIG. 5.

A fusing device 2100 according to still another embodiment of the present disclosure will be described with reference to FIG. 10. However, to describe the fusing device 2100 according to a third embodiment, since the second heating source 140 is the same as that in the embodiment illustrated in FIG. 5, a description thereof will be omitted, and a first heating source 2130 which is different from that in the embodiment illustrated in FIG. 5 will be described in detail.

Figure 10:
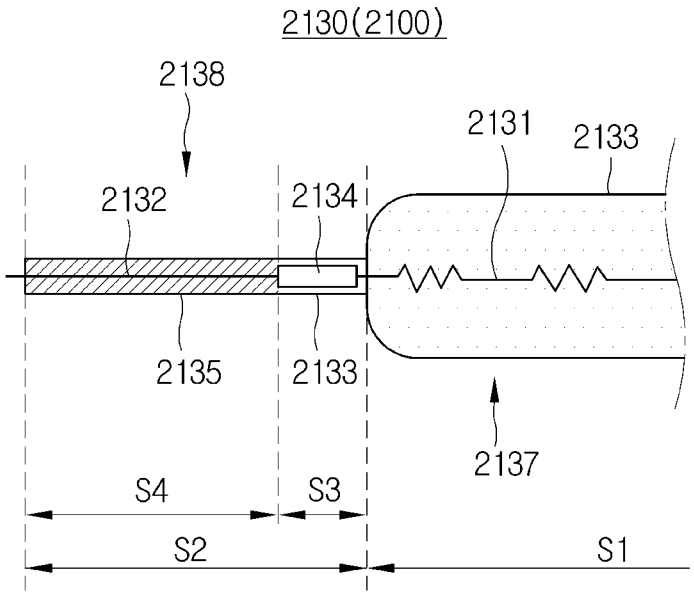

Referring to FIG. 10, the first heating source 2130 includes a first heater 2131 configured to heat a first section S1 for heating a printing medium S having a relatively small width, a first conductor 2132 electrically connected to the first heater 2131 so that the first heater 2131 generates heat, a first body 2133 configured to accommodate a part of the first heater 2131 and the first conductor 2132, and a first connection member 2134 configured to electrically connect the first heater 2131 and the first conductor 2132.

The first heater 2131 is disposed inside the first body 2133 and generates heat when a current is supplied by the first conductor 2132 electrically connected to each of both ends thereof. The first heater 2131 may be a tungsten filament configured to generate heat when a current is supplied and may extend in a width direction of the printing medium S by a preset length.

The first heater 2131 is provided in only a first heater portion 2137 corresponding to the first section S1, like as the embodiment illustrated in FIG. 10, and the first conductor 2132 is electrically connected to each of both ends of the first heater 2131. Here, the first heater 2131 and the first conductor 2132 may be connected to each other by welding similar to that in the embodiment illustrated in FIG. 5, or may be connected through the first connection member 2134.

Specifically, like the embodiment illustrated in FIG. 10, a third section S3 configured to electrically connect the first heater 2131 and the first conductor 2132 is disposed at each of both ends of the first section S1. That is, like the embodiment illustrated in FIG. 10, the first section S1, the third section S3, and the fourth section S4 are sequentially disposed from the center to each of both ends of the first heating source 2130 in a longitudinal direction of the first heating source 2130.

Here, unlike the embodiments illustrated in FIGS. 6 and 9, in the fourth section S4, the first conductor 2132 is sealed by a first sealing member 2135. The first sealing member 2135 has insulation and/or flame retardancy and surrounds and seals the first conductor 2132. The first sealing member 2135 may be a glass tube or ceramic tube.

The first heating source 2130 according to the embodiment illustrated in FIG. 10 is formed with a first heater portion 2137, in which the first heater 2131 generates heat in the portion corresponding to the first section S1, and a first non-heater portion 2138, in which heat is hardly generated in the portion corresponding to the second section S2 including the third section S3 and the fourth section S4, even when power is supplied through the first conductor 2132 similar to the embodiment illustrated in FIG. 6.

Accordingly, the first heating source 2130 according to the embodiment illustrated in FIG. 10 may prevent a decrease in printing performance and a decrease in printing speed due to overheating in an unnecessary portion even when the printing medium S having a relatively small width is printed similar to the embodiment illustrated in FIG. 5.

A fusing device 3100 according to yet another embodiment of the present disclosure will be described with reference to FIG. 11. However, to describe the fusing device 3100 according to the embodiment illustrated in FIG. 11, since the first heating source 130 is the same as that in the embodiment illustrated in FIG. 5, the same reference number as that in the embodiment illustrated in FIG. 5 is used, a description thereof will be omitted, and a second heating source 3140 which is different from that in the embodiment illustrated in FIG. 5 will be described in detail.

Figure 11:
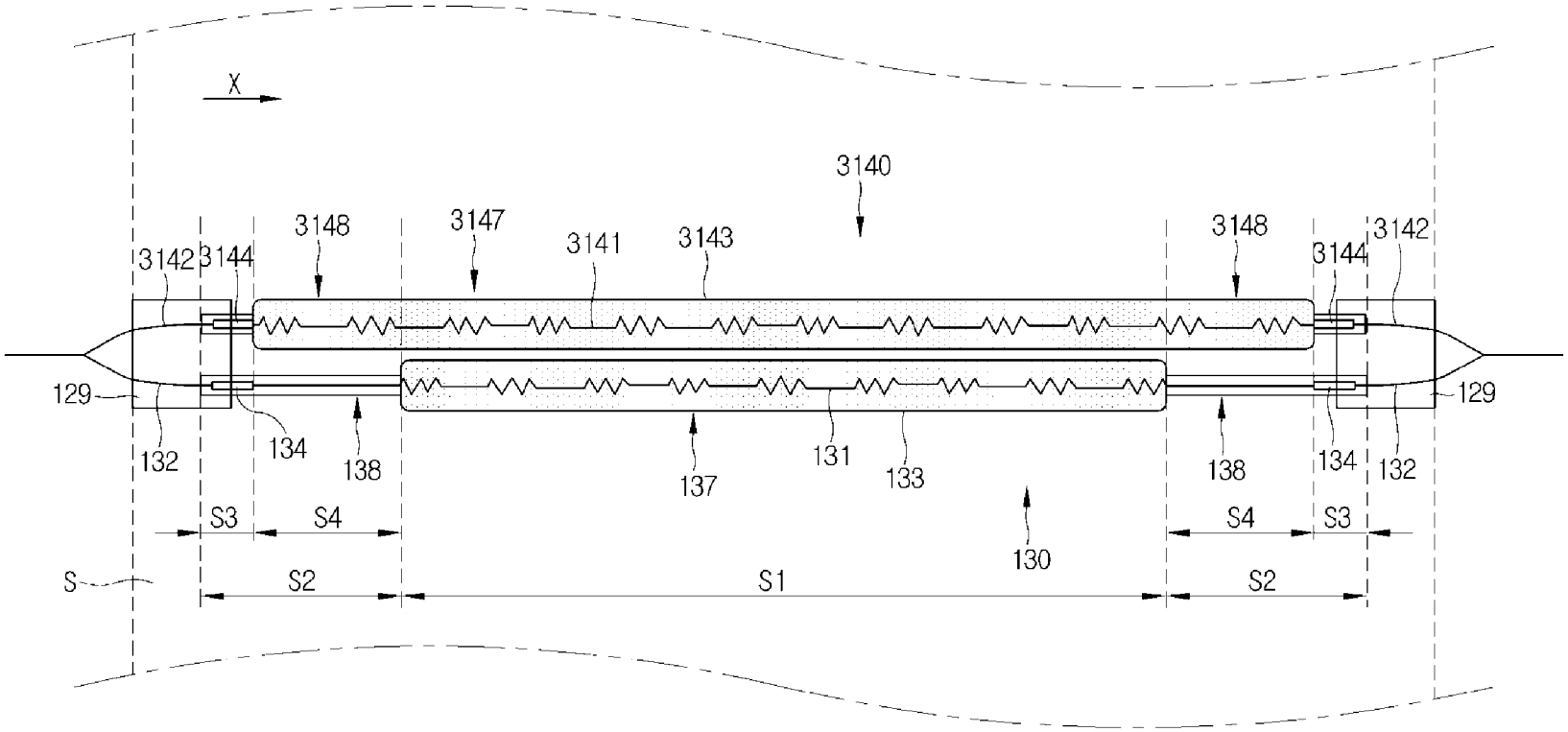
FIGS. 11 and 12 are views illustrating various modified embodiments of the second heating source illustrated in FIG. 5.

Referring to FIG. 11, the second heating source 3140 includes a second heater 3141 configured to heat a first section S1 and a fourth section S4 for heating a printing medium S having a relatively large width, a second conductor 3142 electrically connected to the second heater 3141 so that the second heater 3141 generates heat, a second body 3143 configured to accommodate a part of the second heater 3141 and the second conductor 3142, and a second connection member 3144 configured to electrically connect the second heater 3141 and the second conductor 3142.

The second heater 3141 is disposed inside the second body 3143 and generates heat when a current is supplied by the second conductor 3142 electrically connected to each of both ends thereof. The second heater 3141 may be a tungsten filament configured to generate heat when a current is supplied, similar to the embodiment illustrated in FIG. 5. The second heater 3141 extends in the width direction of the printing medium S by a preset length.

Here, the second heater 3141 according to the embodiment illustrated in FIG. 11 may be provided to have uniform density in the width direction of the printing medium S, unlike the embodiment illustrated in FIG. 5. The second heater 3141 included in a first portion 3147 of the second heating source 3140 corresponding to the first section S1 and a second portion 3148 of the second heating source 3140 corresponding to the fourth section S4 forms a second heater portion.

In the fusing device 3100 according to the embodiment illustrated in FIG. 11, a controller (not shown) of the image forming apparatus 1 controls to supply power to only the first heating source 130 when a printing medium having a relatively small width is printed, and controls to supply power to only the second heating source 3140 when a printing medium having a relatively large width is printed, unlike the fusing device 100 illustrated in FIG. 5.

Since the fusing device 3100 according to the embodiment illustrated in FIG. 11 selectively supplies power to the first and second heating sources 130 and 3140 according to the size of a paper sheet, power consumption may be decreased.

A fusing device 4100 according to yet another embodiment of the present disclosure will be described with reference to FIG. 12. However, to describe the fusing device 4100 according to the embodiment illustrated in FIG. 12, since the first heating source 130 is the same as that in the embodiment illustrated in FIG. 5, the same reference number as that in the embodiment illustrated in FIG. 5 is used, a description thereof will be omitted, and a second heating source 4140 which is different from that in the embodiment illustrated in FIG. 5 will be described in detail.

Figure 12:
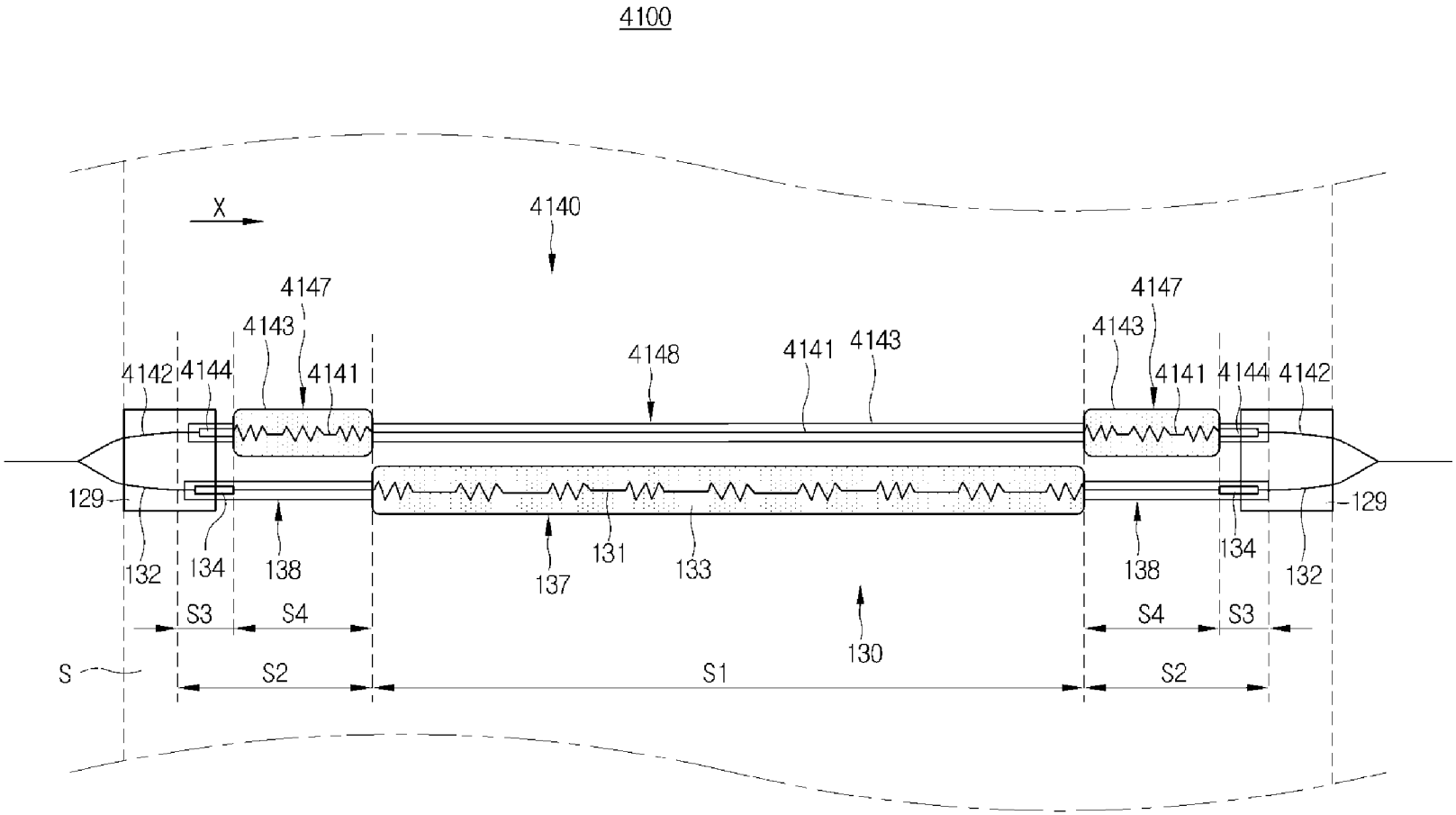

Referring to FIG. 12, the second heating source 4140 includes a second heater 4141 configured to heat a fourth section S4, a second conductor 4142 electrically connected to the second heater 4141 so that the second heater 4141 generates heat, a second body 4143 configured to accommodate a part of the second heater 4141 and the second conductor 4142, and a second connection member 4144 configured to electrically connect the second heater 4141 and the second conductor 4142.

The second heater 4141 is disposed inside the second body 4143 and generates heat when a current is supplied by the second conductor 4142 electrically connected to each of both ends thereof. The second heater 4141 may be a tungsten filament configured to generate heat when a current is supplied, similar to the embodiment illustrated in FIG. 5.

Specifically, a portion corresponding to the fourth section S4 of the second heater 4141 is provided with a halogen gas in a hollow formed inside the second body 4143 to heat the second section S2. Accordingly, when power is supplied to the second heater 4141 through the second conductor 4142, a portion corresponding to the fourth section S4 of the second heater 4141 generates heat and the fourth section S4 is heated. That is, a part of the second heating source 4140 corresponding to the fourth section S4 forms a second heater portion 4147.

Figure 13:
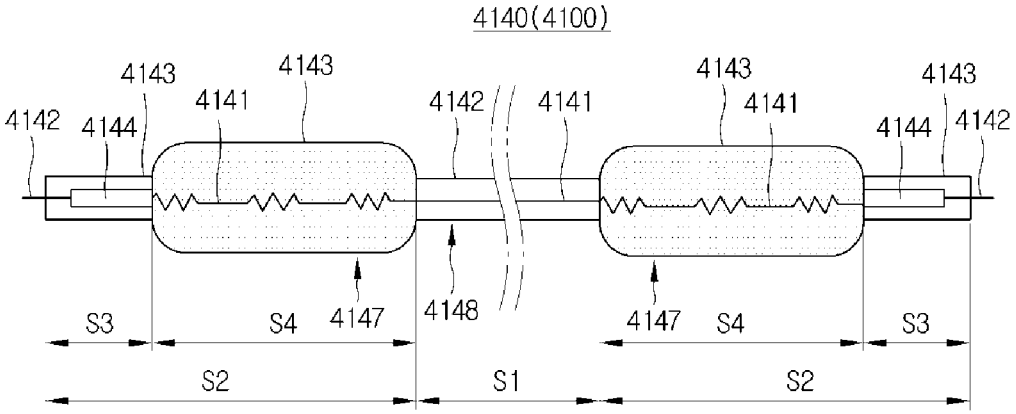
FIG. 13 is an enlarged view of a second non-heater portion of the second heating source illustrated in FIG. 12.

However, referring to FIG. 13, a portion corresponding to the first section S1 of the second heater 4141 is sealed by the second body 4143 to be blocked from the halogen gas. That is, a part of the second body 4143 corresponding to the first section S1 may be formed to fully surround the second heater 4141 by heat seal. Accordingly, a second non-heater portion 4148 is formed in the portion corresponding to the first section S1 of the second heating source 4140. Accordingly, even when power is supplied to the second heater 4141 through the second conductor 4142, heat is hardly generated in a part of the second heater 4141 corresponding to the first section S1. However, the second heater 4141 may electrically connect the second heaters 4141, which are respectively disposed at both ends of the second heating source 4140, to each other so that electricity may flow in the second heating source 4140.

The fusing device 4100 according to the embodiments illustrated in FIGS. 12 and 13 supplies power to only the first heating source 130 when a printing medium S having a relatively small width is printed, similar to the fusing device 100 illustrated in FIGS. 5 and 6. Accordingly, a part of the first heater 131 corresponding to the first section S1 generates heat, and a remaining part of the first heater 131 corresponding to the fourth section S4 does not generate heat.

Otherwise, when a printing medium S having a relatively large width is printed, power is supplied to both of the first heating source 130 and the second heating source 4140. Accordingly, the first section S1 is heated by the first heating source 130, and the fourth section S4 is heated by the second heating source 4140. That is, the first heating source 130 and the second heating source 4140 cooperate to heat the entire printing medium S having a large width.

A control method of selectively supplying a current to the first heating source 4130 and the second heating source 4140 may use the same control method as a control method of selectively supplying a current to the first heating source 130 and the second heating source 140 of the fusing device 100 illustrated in FIGS. 5 to 7.

The fusing device 4100 according to the embodiments illustrated in FIGS. 12 and 13 selectively supplies power to the first and second heating sources 130 and 4140 according to the size of a paper sheet, and since a length of a section in which the second heating source 4140 generates heat is relatively small, power consumption can be decreased.

A fusing device 5100 according to yet another embodiment of the present disclosure will be described with reference to FIG. 14. However, to describe the fusing device 5100 according to the embodiment illustrated in FIG. 14, since the first heating source 130 is the same as that in the embodiment illustrated in FIG. 5, a description thereof will be omitted, and a second heating source 5140 which is different from that in the embodiment illustrated in FIG. 5 will be described in detail.

Figure 14:
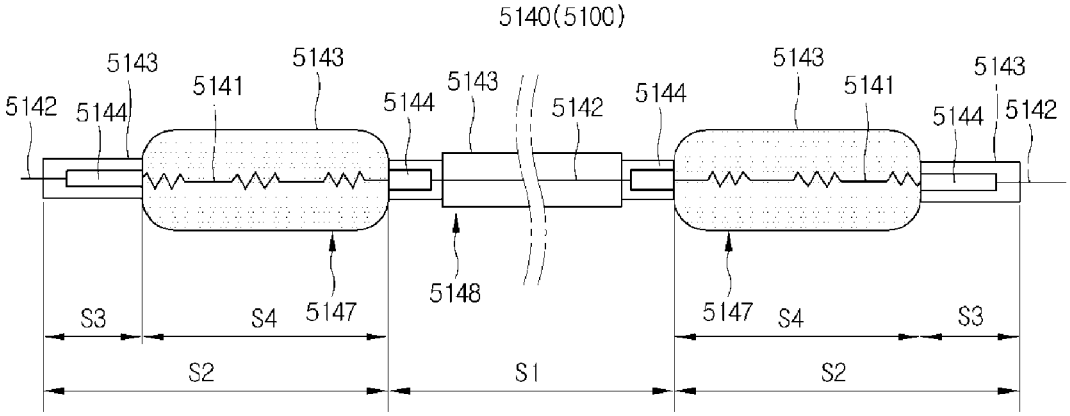
FIGS. 14 and 15 are views illustrating various modified embodiments of the second non-heater portion illustrated in FIG. 13.

Referring to FIG. 14, in the second heating source 5140, a second conductor 5142 may be disposed in a second non-heater portion which is a portion corresponding to a first section S1.

Specifically, a part of the second heating source 5140 corresponding to a fourth section S4 may be provided with a second heater 5141 and a halogen gas, which are accommodated inside a second body 5143, to form a second heater portion 5147. Each of both ends of the second heater 5141 is electrically connected to the second conductor 5142 through a second connection member 5144 disposed in each of the first section S1 and a third section S3. However, as described above, the second heater 5141 and the second conductor 5142 may be directly connected to each other by heat seal.

A part disposed in the portion corresponding to the first section S1 of the second conductor 5142 is sealed by the second body 5143. That is, a part of the second body 5143 corresponding to the first section S1 may be formed to fully surround the second conductor 5142 disposed in the portion corresponding to the first section S1 by heat seal. Accordingly, a second non-heater portion 5148 is formed in the second heating source 5140 corresponding to the first section S1. Accordingly, even when power is supplied to the second heater 5141 through the second conductor 5142 disposed at each of both ends of the second heating source 5140, the second non-heater portion 5148 of the second heating source 5140 does not generate heat. However, the second heater 5141 included in the second non-heater portion 5148 may electrically connect the second heaters 5141 disposed at both ends of the second heating source 5140, and thus electricity may flow in the second heating source 5140.

In the second heating source 5140 according to the embodiment illustrated in FIG. 14, only the second heater portion 5147 corresponding to the fourth section S4 generates heat, and the portion corresponding to the first section S1 and the third section S3 does not generate heat, even when power is supplied through the second conductor 5142, similar to the embodiment illustrated in FIG. 13.

A fusing device 6100 according to yet another embodiment of the present disclosure will be described with reference to FIG. 15. However, to describe the fusing device 6100 according to the embodiment illustrated in FIG. 15, since the first heating source 130 is the same as that in the embodiment illustrated in FIG. 5, a description thereof will be omitted, and a second heating source 6140 which is different from that in the embodiment illustrated in FIG. 5 will be described in detail.

Figure 15:
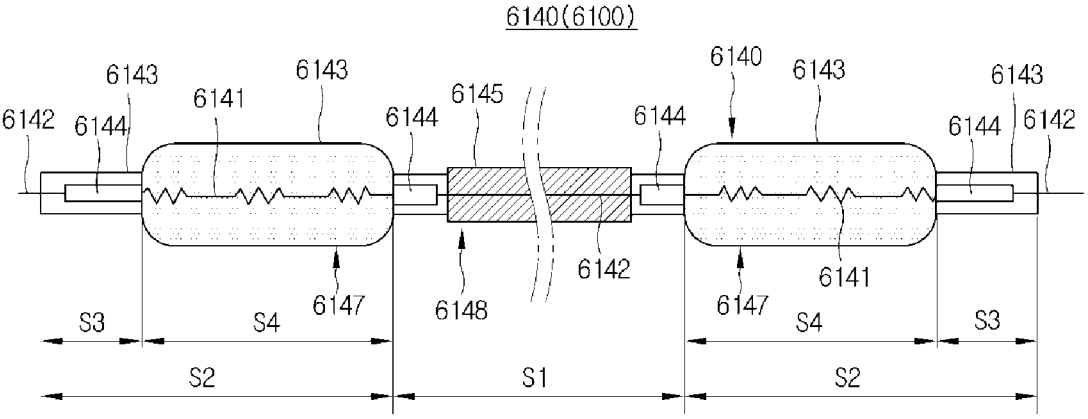

Referring to FIG. 15, in the second heating source 6140, a second conductor 6142 disposed in a second non-heater portion 6148 which is the portion corresponding to a first section S1 may be sealed by a second sealing member 6145.

Specifically, a part of the second heating source 6140 corresponding to a fourth section S4 may be provided with a second heater 6141 and a halogen gas, which are accommodated inside a second body 6143, to form a second heater portion 6147. Each of both ends of the second heater 6141 is electrically connected to the second conductor 6142 through a second connection member 6144 disposed in each of the first section S1 and a third section S3. However, as described above, the second heater 6141 and the second conductor 6142 may be directly connected to each other by welding.

A part disposed in the portion corresponding to the first section S1 of the second conductor 6142 is sealed by the second sealing member 6145. That is, the second sealing member 6145 is disposed at the portion corresponding to the first section S1 of the second heating source 6140 and surrounds and seals the second conductor 6142 to form the second non-heater portion 6148. The second sealing member 6145 may have insulation and/or flame retardancy like the above-described first sealing member 2135 and may be a glass tube or ceramic tube.

In the second heating source 6140 according to the embodiment illustrated in FIG. 15, even when power is supplied through the second conductor 6142, only the portion corresponding to a fourth section S4 generates heat, and the portion corresponding to the first section S1 and a third section S3 does not generate heat, similar to the embodiment illustrated in FIG. 13.

As described above, the image forming apparatus 1 according to the present disclosure may heat a part of the first heating sources 130, 1130, and 2130 and the second heating sources 140, 3140, 4140, 5140, and 6140 of the fusing devices 100, 1100, 2100, 3100, 4100, 5100, and 6100 so as to prevent a decrease in printing performance and a decrease in printing speed due to overheating.

As is apparent from the above description, when small-sized paper is printed, since a part of section of a part of heating source of two or more heating sources of a fusing device generates heat and a remaining section does not generate heat, printing performance can be improved.

Since overheating of the fusing device caused by a heating source is not generated, printing time is decreased and quick printing can be possible.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A fusing device comprising:

a first heating source including a first heater and a first conductor connected to the first heater;

a second heating source including a second heater and a second conductor connected to the second heater;

a fusing member to be heated by one or more of the first heating source and the second heating source; and a pressing member disposed to face the fusing member to press a printing medium toward the fusing member, wherein the first heating source includes a non-heater portion configured to block heat generated from a part of the first heating source in which a portion of the first heater or a portion of the first conductor are sealed.

2. The fusing device of claim 1, wherein:

the first heating source includes a body having the first heater disposed therein, the body being formed to extend in a width direction of the printing medium;

a heater portion including a gas in a hollow is provided in a part of the body for heating the first heater; and the non-heater portion is formed in a remaining part of the body so that the gas is blocked from the first heater or the first conductor disposed in the remaining part of the body.

3. The fusing device of claim 2, wherein the remaining part of the body in which the non-heater portion is provided is formed to surround the first heater or the first conductor by heat seal.

4. The fusing device of claim 2, wherein a cross section of the heater portion which is perpendicular to the width direction of the printing medium has a size or shape which is different from a cross section of the non-heater portion which is perpendicular to the width direction of the printing medium.

5. The fusing device of claim 2, wherein the non-heater portion is formed on each of both ends of the heater portion.

6. The fusing device of claim 1, wherein the first heating source includes two or more portions having different sizes or shapes of cross sections perpendicular to a width direction of the printing medium.

7. The fusing device of claim 1, wherein, when the first conductor is sealed in the non-heater portion, the first conductor is sealed by a sealing member having insulation or flame retardancy.

8. The fusing device of claim 7, wherein the sealing member is formed of glass or ceramic.

9. The fusing device of claim 1, further comprising:

a connection member provided between the first heater and the first conductor, the connection member being configured to electrically connect the first heater and the first conductor.

10. The fusing device of claim 1, wherein the second heater is formed to be longer than the first heater so that a second heating section of the second heater is greater than a first heating section of the first heater and includes the first heating section.

11. The fusing device of claim 10, wherein a heat value for each section of a first portion of the second heater corresponding to the first heating section is smaller than a heat value for each section of a second portion which is a portion excluding the first portion of the second heater.

12. The fusing device of claim 10, wherein a heat value for each section of the second heater is uniform in a width direction of the printing medium.

13. The fusing device of claim 1, wherein the non-heater portion is a first non-heater portion and a heater portion is a first heater portion, and the second heating source includes:

a second heater portion disposed corresponding to the first non-heater portion; and a second non-heater portion partitioned from the second heater portion, in which the second heater or the second conductor is sealed so that heat is not generated.

14. The fusing device of claim 13, wherein the second heater portion is formed on each of both ends of the second non-heater portion.

15. The fusing device of claim 1, wherein the non-heater portion is a first non-heater portion;

the second heating source includes a body having the second heater disposed therein, the body being formed to extend in a width direction of the printing medium;

a heater portion including a gas in a hollow is provided in a part of the body for heating the second heater; and a second non-heater portion partitioned from the heater portion is formed in a remaining part of the body so that the gas is blocked from the second heater or the second conductor disposed in the remaining part of the body.

16. The fusing device of claim 1, further comprising:

a connection member provided between the second heater and the second conductor, the connection member being configured to electrically connect the second heater and the second conductor.

17. An image forming apparatus comprising:

a fusing device configured to fuse a visible image transferable to a printing medium;

the fusing device including:

a first heating source including a first heater, a body having the first heater disposed therein, the body formed to extend in a width direction of the printing medium, and a first conductor connected to the first heater;

a second heating source including a second heater, a second conductor connected to the second heater, the second heater being formed to be longer than the first heater so that a second heating section is greater than a first heating section of the first heater and includes the first heating section;

a fusing member to be heated by one or more of the first heating source and the second heating source; and a pressing member disposed to face the fusing member, the pressing member being configured to press the printing medium toward the fusing member, wherein the body includes:

a hollow;

a heater portion including a gas in the hollow; and a non-heater portion to block the first heater or the first conductor from the gas in which the first heater or the first conductor is sealed.

18. The image forming apparatus of claim 17, wherein a part of the body in which the non-heater portion is provided is formed to surround the first heater or the first conductor by heat seal.

19. A fusing device, comprising:

a fusing member configured to fuse a visible image to a printing medium;

a pressing member disposed to face the fusing member, the pressing member being configured to press the printing medium toward the fusing member;

a first halogen lamp including a halogen gas and a first heater extending in a width direction of the printing medium to heat the fusing member, the first heater being provided with a non-heater portion in which a part of the first heater is sealed to be blocked from heat from the halogen gas; and a second halogen lamp provided with a second heater extending in the width direction of the printing medium to heat the fusing member.

20. The fusing device of claim 19, wherein:

the first halogen lamp includes a body configured to accommodate the first heater therein; and a part of the body in which the non-heater portion is formed surrounds the first heater by heat seal.

* * * * *